US005555814A

United States Patent [19]

Burkhalter et al.

[11] Patent Number: 5,555,814

[45] Date of Patent: Sep. 17, 1996

[54] TRACK FOR SORTATION HANDLING EQUIPMENT

[75] Inventors: Kenneth E. Burkhalter, Chelsea; Ron Cailey, Elk Rapids, both of Mich.

[73] Assignee: Symorex Inc., Ann Arbor, Mich.

[21] Appl. No.: 498,933

[22] Filed: Jul. 6, 1995

Related U.S. Application Data

[63] Continuation of Ser. No. 176,384, Jan. 3, 1994, abandoned.

[51] Int. Cl.[6] ..... B61B 3/00; E01B 25/08

[52] U.S. Cl. ..... 104/107; 104/93; 104/109; 104/119; 105/150

[58] Field of Search ..... 104/84, 93, 95, 104/106, 107, 108, 109, 118, 119; 105/141, 144, 148, 150, 154

[56] References Cited

U.S. PATENT DOCUMENTS

| | | | |
|---|---|---|---|
| 843,520 | 2/1907 | Davy | 104/119 X |
| 2,954,743 | 10/1960 | Henderson | 105/154 |
| 3,012,519 | 12/1961 | Bingham | 104/120 |
| 3,777,669 | 12/1973 | Lott et al. | 104/130 |
| 4,402,272 | 9/1983 | Habegger | 104/119 X |
| 4,423,685 | 1/1984 | Kerckoff | 105/150 |
| 4,480,157 | 10/1984 | Ishikura et al. | 104/93 X |
| 4,503,778 | 3/1985 | Wilson | 104/28 |
| 4,520,733 | 6/1985 | Willmann | 104/93 |
| 4,779,537 | 10/1988 | Hafner et al. | 104/93 |
| 4,860,662 | 8/1989 | Matsumoto et al. | 104/107 X |
| 4,903,610 | 2/1990 | Matsumoto et al. | 104/118 |
| 5,012,746 | 5/1991 | Bormann et al. | 104/107 X |
| 5,235,917 | 8/1993 | Luck et al. | 104/119 |

FOREIGN PATENT DOCUMENTS

| | | | |
|---|---|---|---|
| 2187403 | 9/1987 | United Kingdom | 104/109 |

*Primary Examiner*—S. Joseph Morano
*Attorney, Agent, or Firm*—Young & Basile, P.C.

[57] ABSTRACT

An improved monorail-type track section for use in a material handling and sortation system in which one or more train-type trolleys or cars runs along the track between various sortation and handling stations. The track section comprises a substantially hollow, vertical support member terminating at an upper end in an upper transverse leg defining upper wheel bearing surfaces on each side of the support, and terminating at a base end in a transversely extending base leg defining lower wheel bearing surfaces on each side of the vertical support. The upper and lower wheel bearing surfaces are angled to trap upper and lower wheel assemblies on a trolley in a torsionally stable mounting arrangement. The spacing of the upper wheel bearing surfaces is less than that of the lower wheel bearing surfaces, such that removal of the upper wheel assemblies allows the entire trolley to be lifted vertically off the track section with clearance for the lower wheel assemblies.

10 Claims, 2 Drawing Sheets

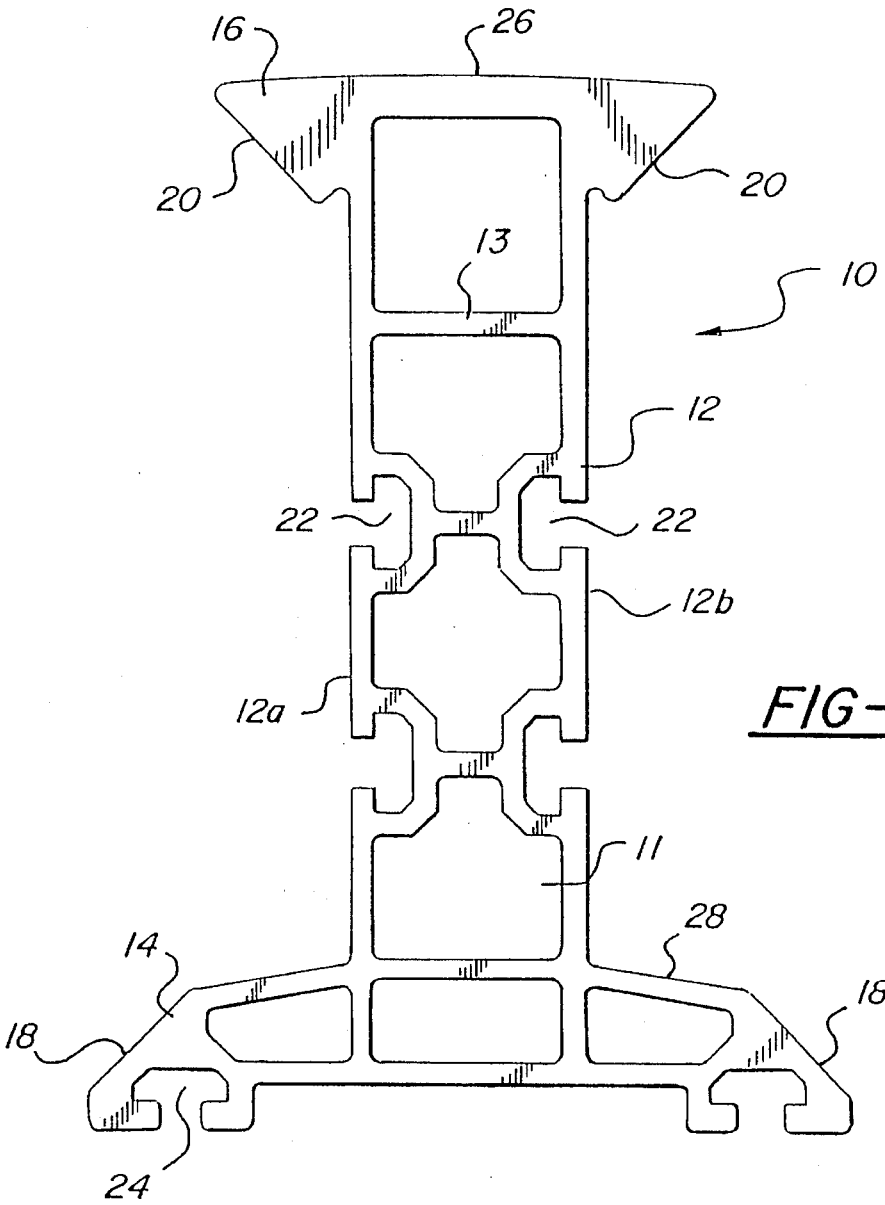
FIG-1
FIG-3
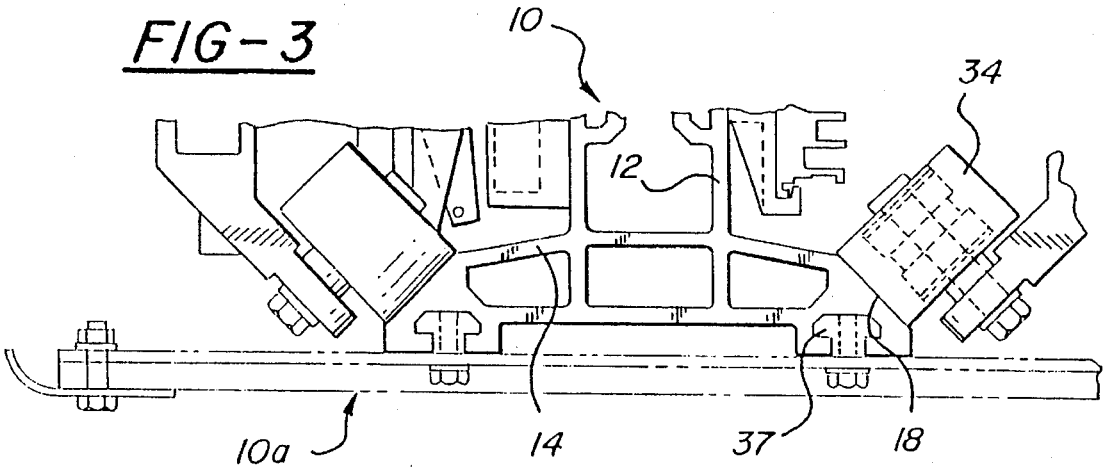

TRACK FOR SORTATION HANDLING EQUIPMENT

This is a continuation of application Ser. No. 08/176,384 filed on Jan. 3, 1994 now abandoned.

FIELD OF THE INVENTION

The present invention is generally related to automated material handling systems where a train-type vehicle is guided on a monorail-type track to transport goods between discharge and induction stations.

BACKGROUND OF THE INVENTION

U.S. Pat. No. 5,018,928 to Hartlepp discloses an automated, train- and track-type material handling and sortation system in which series of cars are pulled by a tug or locomotive unit on a monorail-type track between sortation stations to receive, transport and discharge goods. The cars or trolleys which carry the goods and associated tilt tray structure travel on a monorail-type track shown in cross-section in FIG. 4. Trolleys include a number of inwardly-facing wheels which ride on upper and lower wheel surfaces of the track.

The track itself is described as having a generally I-shaped cross-section with a central, vertical web 90 and upper and lower transverse arms angled outwardly and upwardly to define the wheel surfaces. The track cross-section and location of the wheel surfaces is designed to locate the car against forces in all directions so that the car remains upright and travels along the track in a stable manner.

SUMMARY OF THE INVENTION

The present invention is directed to an improved monorail-type track cross-section and construction which provides superior stability for a sortation car or trolley traveling therealong, improved ease of detaching and replacing trolleys in the track, higher strength and lower weight, and a novel means for attaching, positioning and adjusting various track-mounted structure such as power buss bars, tipping ramp structures, etc.

In general the track comprises an extruded, honeycombed track cross-section with a central vertical web terminating at its upper and lower ends in transverse arms which define upper and lower wheel bearing surfaces. The upper wheel surfaces are angled downwardly and outwardly, while the lower wheel bearing surfaces are angled upwardly and outwardly. The ends of the upper transverse arm defining the wheel bearing surfaces are spaced a distance less than the ends of the lower transverse arm defining the lower wheel bearing surfaces to facilitate the vertical removal of a trolley from the track section by removing only one of the upper wheel assemblies.

The track cross-section of the present invention is further provided with a novel continuous nut slot structure which provides a continuous sliding mount for various track-mounted devices such as power buss bars and tipping ramps using T-shaped nuts. The nut slot structure allows track-mounted devices to be slidably positioned at any location along a track section merely by loosening the nuts holding the device to the track and sliding the device along the length of the track in the desired direction.

The nut slots of the invention can also be provided in the base arm of the track cross-section for sliding, positioning and adjustment of an underlying support or pedestal relative to the track section with the T-shaped nuts. Alternate structure such as sideguard mounting brackets or track-side mounted sensors can also be mounted to the track using the nut slots.

The nut slots of the invention eliminate the need for drilling, tapping, welding and other field operations to mount structure to the track sections.

These and other advantages of the invention will become apparent upon further reading of the specification.

BRIEF DESCRIPTION OF THE DRAWINGS

FIG. 1 is an end cross-section view of the track according to the present invention;

FIG. 3 is a partial side view of the base end of the track section according to FIG. 2 mounted to a support pedestal.

DETAILED DESCRIPTION OF THE DRAWINGS

Figure 2:
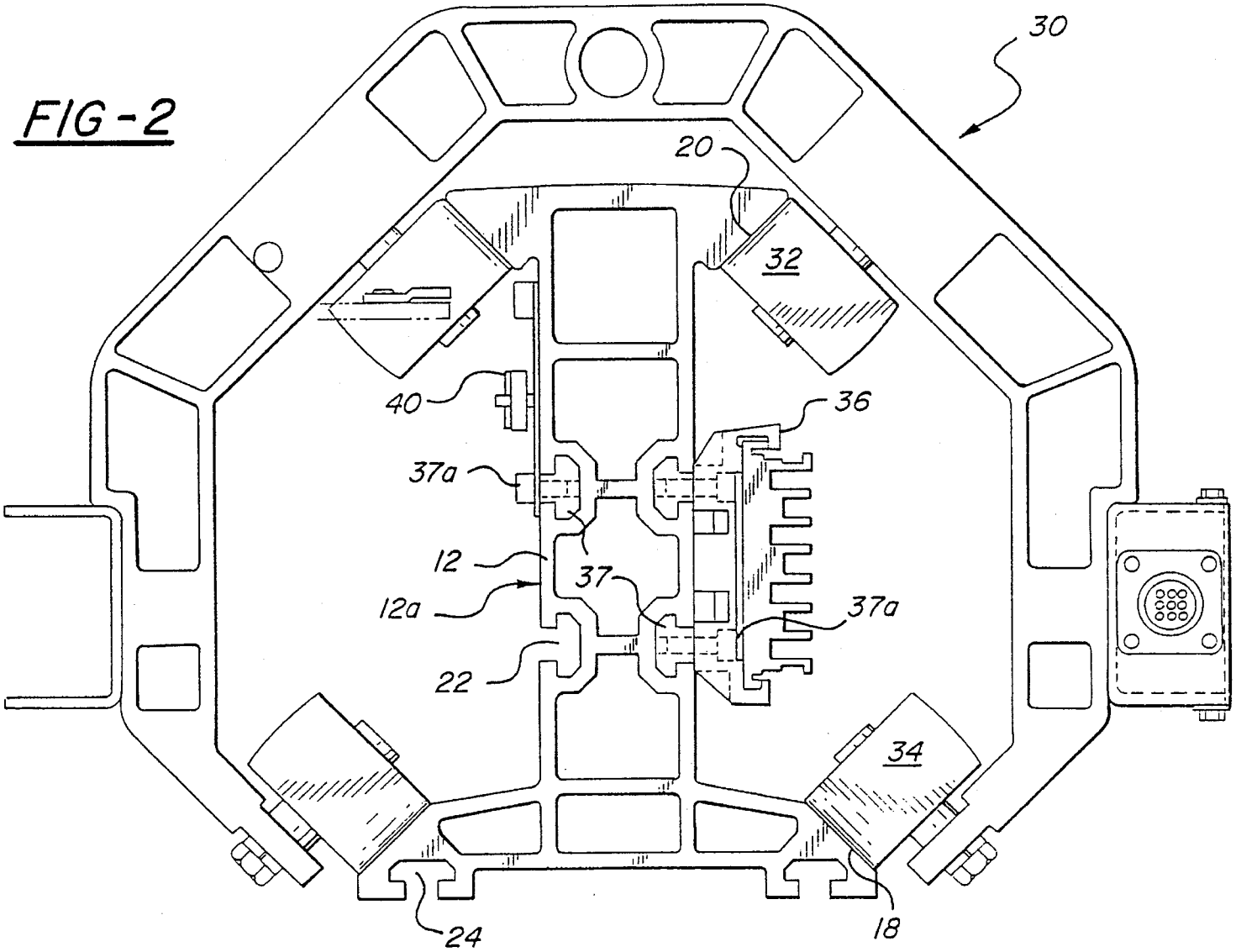
FIG. 2 is an end section view of the track of FIG. 1 and an associated sortation trolley car and track-mounted devices.

Referring now to FIG. 1, a monorail track section 10 according to the present invention is shown comprising an extruded, honeycombed body 12 having a number of hollow portions 11 and transverse webs 13. In the illustrated embodiment the track section is preferably extruded from a suitable aluminum alloy to result in a combination of high strength and low weight. The track section 10 further includes a wider transverse base leg 14 essentially perpendicular to support 12, and a narrower upper leg 16 essentially perpendicular to support 12, respectively defining angled lower wheel surfaces 18 and upper wheel surfaces 20 at the outer or distal ends thereof. The vertical web or body 12 of the track section 10 has integrally formed therein a number of continuous, substantially T-shaped nut slots 22 which extend in rectilinear fashion along the entire length of track section 10.

Similar nut slots are provided in the transverse base leg 14 at the outer ends thereof, also extending along the length of the track.

Nut slots 22 on the vertical body 12 of the track section are used to mount track-mounted devices in a manner described below. Base nut slots 24 are used to slidingly mount and adjust a track section to a suitable pedestal or support provided with commercially-available T-shaped mating nuts held in the slots in a manner described below.

The upper surfaces 26,28 of the transverse legs of track section 10 are slightly convex as illustrated, to assist in shedding water, debris and the like. The curvature of upper surface 26 on upper transverse leg 16, however, is slight, to permit engagement with a friction traction drive wheel on a tug or locomotive car which together with wheel assemblies running on opposed wheel bearing surfaces 20 firmly grasps or pinches the track section 10 therebetween. The opposed relationship of upper traction drive surface 26 to upper wheel bearing surfaces 20 permits a strong, opposing grasp of the track by a tug between its powered drive wheel and upper guide wheel assemblies 32 on surfaces 20.

Referring now to FIG. 2, a trolley 30 having upper and lower wheel assemblies 32,34 riding on upper and lower wheel surfaces 20,18 is illustrated. It can be seen from the drawing that the respective angles of the upper and lower wheel surfaces 18,20 effectively trap the horseshoe-shaped trolley 30 by its inwardly angled wheels 32,34 on the track. This arrangement provides good rotational stability of the trolley 30 on track 10.

Additionally, the relatively wide vertical web or body 12 and the hollow, honeycombed, extruded cross-section provides a high degree of strength and torsional stability in the track section itself. In the illustrated embodiment the height of the track section from convex upper surface 26 to the lower surface of base leg 14 is approximately 226.0 mm, the width of base leg 14 from end to end is approximately 164.0 mm, the width of upper transverse leg 16 is approximately 108.0 mm, and the width of vertical web 12 from side surface 12*a* to side surface 12*b* is approximately 50.0 mm.

Still referring to FIG. 2, track section 10 is provided with a power bus bar 36 which powers the trolley in a known manner. Bus bar 36 is attached to side surface 12*b* of track section 10 with bolts 37*a* engaging commercially available T-shaped nuts 37. Nuts 37 are slidably held within nut slots 22 when inserted transversely anywhere along the length of the nut slot in the track. In the illustrated embodiment T-shaped nuts 37 are of the type commercially available from Bosch, with a rectangular shape having two diagonally-opposed rounded corners which permit a 90° rotation of the nut in the rectangular slot after insertion. When bolt 37*a* is tightened further, the non-rounded corners bind-with the slot to prevent further rotation, permitting the bolt to be axially tightened and transversely locking the nut and its associated device to the track. Bus bar 36 can be slidably mounted anywhere on track section 10 by inserting nuts 37 into nut slots 22 and positioning the bus bar at the desired location along the length of the track section. At the desired position the nuts are rotated a quarter turn as the bolt is tightened in known manner, for example with an allen wrench or screwdriver. To adjust the position of bus bar 36, or to remove it entirely from track section 10, it is a simple manner to loosen the compressive frictional fit between bus bar 36 and the track by loosening bolts 37*a* and rotating nuts 37 to their original inserted position in which they slide within the slots, and then transversely removing or sliding bus bar 36 to the desired location.

Also shown in FIG. 2 is a track locator mechanism 40 attached to the left side surface 12*a* of track section 10 using the same nut and slot arrangement 22,37. It will be apparent to those skilled in the art that virtually any device desired to be mounted on the sides of track 10 can be quickly and easily positioned, adjusted or removed using this arrangement.

As shown in FIG. 3, the same nut and slot arrangement can be used in base leg 14 to provide easily-adjusted means for slidably positioning a suitable support or pedestal such as 10*a* on track section 10. Alternately, base nut slots 24 and nuts 37 can be used for mounting other structure such as a sideguard to base leg 14 in the manner described above for the bus bar example.

The foregoing description is of an illustrative embodiment of the invention. Various modifications to the illustrated embodiment can be made and still lie within the scope of the appended claims.

We claim:

1. For use in a train-type sortation system in which one or more cars or trolleys rides on a monorail-type track, an improved unitary track section comprising:

a vertical support member terminating at an upper end in a first narrower transverse leg and at a lower end in a second wider transverse base leg, the upper and base legs defining at distal ends thereof opposed, inwardly angled wheel bearing surfaces on each side of the vertical support member, wherein the upper wheel bearing surfaces are transversely spaced a distance less than the lower wheel bearing surfaces, such that outer ends of the upper wheel surfaces extend transversely from the vertical support a first distance less than inner ends of the lower wheel bearing surfaces, the outer ends of the upper wheel surfaces comprising the outer ends of the upper transverse leg.

2. A track section as defined in claim 1, further including at least one nut slot in a side surface of the vertical support member extending continuously along the length of the track to slidingly receive nut means on a track-mounted device for slidingly positioning and adjusting the track-mounted device along the length of the track section.

3. A track section as defined in claim 2, wherein the nut slot is substantially T-shaped to receive a substantially T-shaped nut head therein.

4. A track section as defined in claim 2, wherein the track section includes a said nut slot on each side of the track.

5. Apparatus as defined in claim 2, further including at least one nut slot extending continuously in the base leg of the track section for sliding engagement with a mating nut on a support means.

6. A track section as defined in claim 1, further including a traction drive surface on the first upper transverse leg, the traction drive surface opposed to the wheel bearing surfaces on the first upper transverse leg.

7. A track section as defined in claim 1, wherein the upper transverse leg includes an upper surface comprising a traction drive surface, and a lower surface on which the wheel bearing surfaces are formed

8. A track section as defined in claim 1, wherein the vertical support member is substantially hollow.

9. An improved monorail track and trolley combination for use in a train-type monorail sortation system, comprising:

a monorail track;

a trolley having an inverted, generally horseshoe-shaped cross-section with an open lower end and inwardly-facing upper and lower wheel assemblies for riding on upper and lower wheel bearing surfaces formed on the track; wherein, the track cross-section is essentially I-shaped, with a vertical support member terminating at an upper end in a first narrower transverse upper leg and at a lower end in a second wider transverse base leg, the upper and base legs defining at distal ends thereof opposed, inwardly angled wheel bearing surfaces on each side of the vertical support member, wherein the upper wheel bearing surfaces are transversely spaced a distance less than the lower wheel bearing surfaces such that outer ends of the upper wheel bearing surfaces extend transversely from the vertical support member a first distance less than inner ends of the lower wheel bearing surfaces and that the inverted horseshoe-shaped trolley can be lifted vertically from the track around the transverse upper leg upon removal of a single upper wheel assembly, the track further including a traction drive surface on an upper surface of the first upper transverse leg, the traction drive surface being opposed to the wheel support surfaces on the first upper transverse leg.

10. Apparatus as defined in claim 9, wherein the track is an extruded, substantially hollow body.

* * * * *

UNITED STATES PATENT AND TRADEMARK OFFICE

CERTIFICATE OF CORRECTION

PATENT NO. : 5,555,814

DATED : September 17, 1996

INVENTOR(S) : Burkhalter et al.

It is certified that error appears in the above-indentified patent and that said Letters Patent is hereby corrected as shown below:

Column 3, line 26, delete "bind-with" and insert --bind with--.

Signed and Sealed this

Twenty-sixth Day of November 1996

*Attest:*

Bruce Lehman

BRUCE LEHMAN

*Attesting Officer*

*Commissioner of Patents and Trademarks*